US006318268B1

(12) United States Patent
Maehata et al.

(10) Patent No.: US 6,318,268 B1
(45) Date of Patent: Nov. 20, 2001

(54) DEMOLISHING APPARATUS USING DISCHARGE IMPULSE

(75) Inventors: Hidehiko Maehata; Hiroaki Arai; Tetsuya Inoue; Daisuke Tamakoshi; Katsuya Sasaki; Tsuyoshi Kato, all of Osaka (JP)

(73) Assignee: Hitachi Zosen Corporation (JP)

( * ) Notice: Subject to any disclaimer, the term of this patent is extended or adjusted under 35 U.S.C. 154(b) by 0 days.

(21) Appl. No.: 09/331,717

(22) PCT Filed: Dec. 18, 1997

(86) PCT No.: PCT/JP97/04690

§ 371 Date: Jun. 24, 1999

§ 102(e) Date: Jun. 24, 1999

(87) PCT Pub. No.: WO98/29622

PCT Pub. Date: Jul. 9, 1998

(30) Foreign Application Priority Data

Dec. 27, 1996 (JP) ..... 8-349139
May 30, 1997 (JP) ..... 9-140752

(51) Int. Cl.[7] ..... F42B 3/18; F42B 12/22; F42B 12/32

(52) U.S. Cl. ..... 102/202.7; 102/472; 102/495; 102/497

(58) Field of Search ..... 102/202.7, 440, 102/472, 506, 494, 495, 496, 497

(56) References Cited

U.S. PATENT DOCUMENTS

| | | | | |
|---|---|---|---|---|
| 932,004 | * | 8/1909 | Dreger | 102/497 |
| 2,660,118 | * | 11/1953 | Barocca et al. | 102/202.7 X |
| 3,181,463 | * | 5/1965 | Morgan et al. | 102/202.7 |
| 3,336,452 | * | 8/1967 | Baker | 102/202.7 X |
| 3,429,260 | * | 2/1969 | Corren | 102/202.7 |
| 4,334,474 | * | 6/1982 | Coltharp | 102/202.7 |
| 4,405,104 | * | 9/1983 | Charman et al. | 102/202.7 X |
| 4,576,094 | * | 3/1986 | Meador | 102/202.7 X |
| 4,602,565 | * | 7/1986 | Mac Donald et al. | 102/202.7 |
| 5,115,743 | * | 5/1992 | Loffler | 102/472 |
| 5,452,661 | * | 9/1995 | Neff | 102/202.7 |
| 5,756,925 | * | 5/1998 | Frank et al. | 102/202.7 |
| 5,789,696 | * | 8/1998 | Lee et al. | 102/440 X |
| 5,909,000 | * | 6/1999 | Rakov | 102/440 X |
| 5,969,286 | * | 10/1999 | Ward et al. | 102/202.7 |
| 6,098,548 | * | 8/2000 | Rink et al. | 102/202.7 X |

FOREIGN PATENT DOCUMENTS

| | | |
|---|---|---|
| 0 916 786 A | 5/1999 | (EP) . |
| 63-221857 A | 3/1987 | (JP) . |
| 07233693 A | 2/1994 | (JP) . |
| 07233694 A | 2/1994 | (JP) . |
| 07317330 A | 2/1995 | (JP) . |
| 08218648 A | 2/1995 | (JP) . |
| 08218649 A | 2/1995 | (JP) . |
| 08219698 A | 2/1995 | (JP) . |
| 11131967 | 5/1999 | (JP) . |

* cited by examiner

*Primary Examiner*—Peter A. Nelson
(74) *Attorney, Agent, or Firm*—D. Peter Hochberg; Katherine R. Vieyra; William H. Holt

(57) ABSTRACT

An apparatus which is constituted to supply electrical energy to a melting and vaporizing material (for example metal wire 6) so as to cause the melting and vaporizing material to melt and vaporize, thereby demolishing an object to be demolished (such as concrete 2) using the vaporization and expansion force generated at the time of melting and vaporization of the material; wherein either by providing a granular material 8 which ejects from a container following the generation of the vaporization and expansion force, or by using an inflammable material as demolishing material 46 in which the melting and vaporizing material is immersed, a to-be-demolished object is demolished with a strong demolishing force.

12 Claims, 12 Drawing Sheets

DEMOLISHING APPARATUS USING DISCHARGE IMPULSE

FIELD OF THE INVENTION

The present invention relates to a demolishing apparatus using discharge impulse for demolishing an object to be demolished, such as concrete or rock mass, by using discharge energy.

BACKGROUND ART

So far, dynamite has been known as demolishing means for demolishing an object to be demolished such as concrete or rock mass, however, a danger is involved in handling the dynamite.

A demolishing apparatus using discharge impulse, which uses discharge energy, has been proposed in recent years as a way of eliminating such danger.

This demolishing apparatus using discharge impulse comprises a pair of electrodes connected to each other by means of a metal wire, and an energy supply circuit being connected to these electrodes and adapted to supply electrical energy to the metal wire, wherein the metal wire is immersed in a demolishing material (a liquid such as water or a semisolid material is used) filled in a demolishing container (hereinafter referred to simply as "container").

Next, the demolishing method for the aforementioned demolishing apparatus using discharge impulse will be explained. According to the method, the metal wire is immersed in the container filled with a demolishing material, the demolishing container is installed in an installation hole formed in an object to be demolished, the supply circuit is connected to the electrodes, a capacitor installed in this supply circuit is charged with a prescribed quantity of electrical energy, and this electrical energy is supplied to the metal wire for a short time (for example, several dozen $\mu$s), that is in other words, electric power is discharged. Whereupon, the metal wire suddenly melts and vaporizes and expands in volume. Following this, the demolishing material also suddenly vaporizes and expands. The volume expansion force of the metal wire is transmitted by this demolishing material, and the sudden volume expansion force of the metal wire and the vaporization and expansion force of the demolishing material act on the walls of the installation hole, for example, in such a manner that the installation hole is pressed outward, thereby demolishing the object to be demolished.

However, with the aforementioned demolishing apparatus, the vaporization and expansion force of the demolishing material filled in the container is used to demolish an object to be demolished, so that resultant physical force such as a shock force cannot be sufficient. Therefore, there are such cases, depending on the kind of object to be demolished, that sufficient demolishing force cannot be obtained, and because of this, further improvement of the demolishing force is desired.

It is an object of the present invention to provide a demolishing apparatus using discharge impulse which is capable of resolving the foregoing problems.

DISCLOSURE OF THE INVENTION

The present invention is a demolishing apparatus using discharge impulse in which electrical energy is supplied for a short time to a melting and vaporizing material (for example, a metal wire is used) placed in a container so as to cause the melting and vaporizing material to suddenly melt and vaporize, thereby demolishing an object to be demolished; wherein a container is filled with a demolishing material which vaporizes and expands following the melting and vaporizing of the melting and vaporizing material, and a granular material (metal balls, pebbles, ceramic balls or the like are used) which transmits a direct force to the surroundings by a volume expansion force generated when the melting and vaporizing material melts and vaporizes.

According to this invention, the melting and vaporizing material melts and vaporizes as the electrical energy is supplied to the melting and vaporizing material; the demolishing material vaporizes and expands following the melting and vaporizing of the melting and vaporizing material; the volume expansion force of the melting and vaporizing material is transmitted to the object to be demolished; and the volume expansion force generated during the melting and vaporization of the melting and vaporizing material causes the granular material to give a shock to the object to be demolished, thereby demolishing the object without fail.

Also, the present invention is a demolishing apparatus using discharge impulse which is constituted to supply electrical energy for a short time to a melting and vaporizing material placed in a container so as to cause the melting and vaporizing material to suddenly vaporize and melt, thereby demolishing an object to be demolished; wherein the container is filled with a demolishing material which vaporizes and expands following the melting and vaporization of the melting and vaporizing material, and a granular material which transmits to the surroundings a volume expansion force generated when the melting and vaporizing material melts and vaporizes and a direct shock force; wherein a synthetic resin or paper, or a metal pipe, is used as a material constituting the container; and wherein a cylindrical holding body made of a hard material and having an opening at least at one end thereof is provided in the container such that the container faces the object to be demolished.

According to this constitution of the invention, the melting and vaporizing material melts and vaporizes as the electrical energy is supplied to the melting and vaporizing material; the demolishing material vaporizes and expands following the melting and vaporizing of the melting and vaporizing material; the volume expansion force of the melting and vaporizing material is transmitted to the object to be demolished; and the granular material is ejected from the opening at one end of the cylindrical holding body toward the object to be demolished by the volume expansion force generated during the melting and vaporization of the melting and vaporizing material, thereby demolishing the object to be demolished reliably with the strong demolishing force.

Also, the present invention is a demolishing apparatus using discharge impulse which is constituted to supply electrical energy for a short time to melting and vaporizing material placed in a cylindrical container so as to cause the melting and vaporizing material to suddenly melt and vaporize, thereby demolishing an object to be demolished; wherein the cylindrical container is filled with a demolishing material which vaporizes and expands following the melting and vaporization of the melting and vaporizing material, and a granular material which transmits to the surroundings a volume expansion force generated when the melting and vaporizing material melts and vaporizes; and wherein the cylindrical container is made of a hard material and includes a soft stopper element provided at an opening at one end of the cylindrical container.

According to this constitution of the invention, the melting and vaporizing material melts and vaporizes as the electrical energy is supplied to the melting and vaporizing material; the demolishing material vaporizes and expands following the melting and vaporizing of the melting and vaporizing material; the volume expansion force of the melting and vaporizing material is transmitted to the object to be demolished; and the granular material is caused to break the stopper element from the opening at one end of the cylindrical holding body so as to be ejected toward the object to be demolished, by the volume expansion force generated during the melting and vaporization of the melting and vaporizing material, thereby demolishing the object to be demolished reliably with the strong demolishing force.

Also, the present invention is a demolishing apparatus using discharge impulse which is constituted to supply electrical energy for a short time to melting and vaporizing material placed in a cylindrical container so as to cause the melting and vaporizing material to suddenly melt and vaporize, thereby demolishing an object to be demolished; wherein the cylindrical container is filled with a demolishing material which vaporizes and expands following the melting and vaporization of the melting and vaporizing material, and a granular material which transmits to the surroundings a volume expansion force generated when the melting and vaporizing material melts and vaporizes, said cylindrical container being made of a hard material; wherein a soft stopper element for holding the demolishing material and granular material is provided at a portion partway toward an opening formed at one end of the cylindrical container; and wherein a space portion is formed between the stopper element and the one end of the cylindrical container.

According to this constitution of the invention, the melting and vaporizing material melts and vaporizes as the electrical energy is supplied to the melting and vaporizing material; the demolishing material vaporizes and expands following the melting and vaporizing of the melting and vaporizing material; the volume expansion force of the melting and vaporizing material is transmitted to the object to be demolished; and the granular material is caused to break the stopper element to eject itself from the opening at one end of the cylindrical holding body toward the object to be demolished, by the volume expansion force generated during the melting and vaporization of the melting and vaporizing material, thereby demolishing the object to be demolished reliably with the strong demolishing force.

Also, the present invention is a demolishing apparatus using discharge impulse which is constituted to supply electrical energy for a short time to melting and vaporizing material placed in a cylindrical container so as to cause the melting and vaporizing material to suddenly melt and vaporize, thereby demolishing an object to be demolished; wherein the cylindrical container is filled with a demolishing material which vaporizes and expands following the melting and vaporization of the melting and vaporizing material, and a granular material which transmits to the surroundings the force of volume expansion generated when the melting and vaporizing material melts and vaporizes, said cylindrical container being made of a hard material; wherein a soft stopper element for holding the demolishing material and granular material is provided at a portion partway toward an opening formed at one end of the cylindrical container; wherein a space portion is formed between the stopper element and the one end of the cylindrical container; and wherein a portion of the cylindrical container corresponding to the space portion formed between the stopper element and the one end is formed in a conical shape such that the inner diameter of the portion on the opening side is greater than the inner diameter on the stopper element side.

According to this constitution of the invention, the melting and vaporizing material melts and vaporizes as the electrical energy is supplied to the melting and vaporizing material; the demolishing material vaporizes and expands following the melting and vaporizing of the melting and vaporizing material; the volume expansion force of the melting and vaporizing material is transmitted to the object to be demolished; and the granular material destroys the stopper element and is ejected, but in a limited ejection range, from the opening at one end of the cylindrical holding body toward the object to be demolished, by the volume expansion force generated during the melting and vaporizing of the melting and vaporizing material, thereby demolishing the object to be demolished reliably by the strong demolishing force.

Also, the present invention is a demolishing apparatus using discharge impulse which is constituted to supply electrical energy for a short time to a melting and vaporizing material placed in a cylindrical container so as to cause the melting and vaporizing material to suddenly melt and vaporize, thereby demolishing an object to be demolished; wherein the container is filled with an inflammable demolishing material which burns and vaporizes following the melting and vaporization of the melting and vaporizing material.

According to this constitution of the invention, the melting and vaporizing material melts and vaporizes and expands in volume when electrical energy is supplied to the melting and vaporizing material; following this, the inflammable demolishing material burns and vaporizes; and the burning and vaporizing force of the demolishing material acts, with a time lag, on cracks caused by the volume expansion force of the melting and vaporizing material, thereby reliably demolishing the object to be demolished in such a manner as to expand the cracks outward.

Also, the present invention is a demolishing apparatus using discharge impulse which is constituted to supply electrical energy for a short time to a melting and vaporizing material placed in a cylindrical container so as to cause the melting and vaporizing material to suddenly melt and vaporize, thereby demolishing an object to be demolished; wherein the container is filled with an inflammable demolishing material which burns and vaporizes following the melting and vaporization of the melting and vaporizing material, and a stable material which vaporizes and expands following the melting and vaporization of the melting and vaporizing material, in such a condition that the inflammable demolishing material and the stable material are separated from each other; and wherein the melting and vaporizing material is immersed in both the inflammable demolishing material and the stable demolishing material.

According to this constitution of the invention, the melting and vaporizing material melts and vaporizes and expands in volume when electrical energy is supplied to the melting and vaporizing material; following this, the stable demolishing material vaporizes and expands and causes cracks in the object to be demolished; with a slight time delay from the volume expansion of the melting and vaporizing material and from the vaporization and expansion of the stable demolishing material, the inflammable demolishing material burns and vaporizes; and the burning and vaporizing force of the demolishing material acts on the cracks, thereby reliably demolishing the object to be demolished in such a manner as to expand the cracks outward.

DESCRIPTION OF THE PREFERRED EMBODIMENTS

The present invention is explained in more detail with reference to the appended figures.

Figure 1:
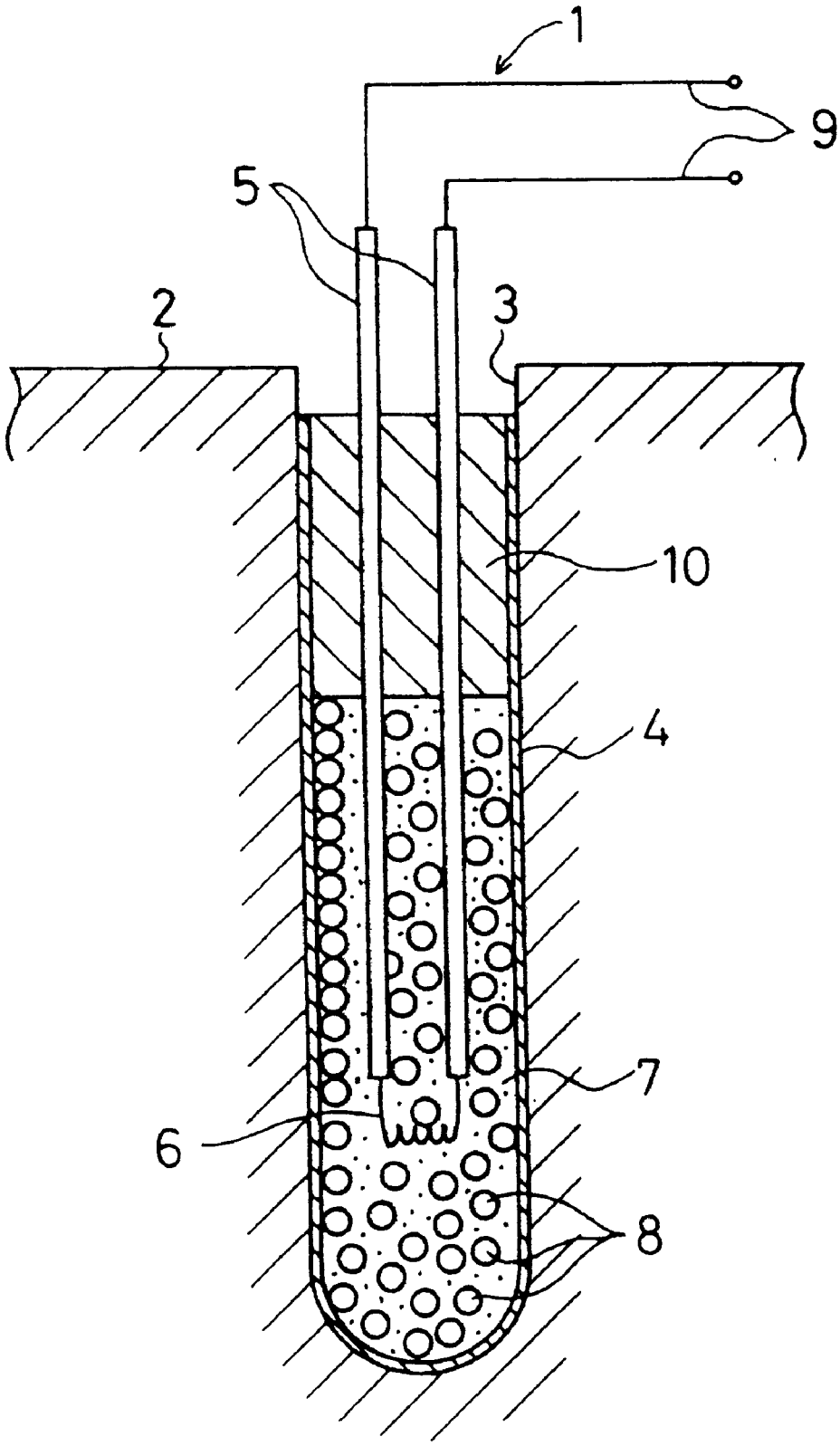
FIG. 1 is a cross section showing the installed state of a demolishing apparatus using discharge impulse in an object to be demolished according to the first embodiment of the present invention.

The first embodiment for implementing the present invention is explained on the basis of FIG. 1. A demolishing apparatus using discharge impulse 1 in this first embodiment comprises: a bottomed cylindrical or pouch-shaped demolishing container (hereinafter, simply referred to as "container") 4 inserted in an installation hole 3 formed in an object to be demolished 2; a pair of electrodes (or conductive wires) 5 inserted in this container 4; a metal wire (an example as a melting and vaporizing material, such as copper, iron or aluminum) 6 connecting the end portions of these electrodes (or conductive wires) 5; a demolishing material 7 and a granular material 8 filled in this container 4; and an electrical energy supplying device (not depicted) to supply high voltage electrical energy for a short time to the base portions of said pair of electrodes 5 by means of electrical wiring 9.

The electrical energy supplying device comprises: a charger, such as a capacitor, to accumulate high voltage electrical energy; a charging circuit to charge this capacitor; and a discharge circuit to supply the electrical energy charged into the capacitor to the metal wire 6 so as to effect discharge. Also the container 4 is formed of a soft material such as synthetic resin or an elastic material such as rubber. Furthermore, used as the demolishing material 7 is a solid or semisolid material, for example, and to be more specific, it is mortar, mud, silicone, or gel. Used as the granular material 8 is metal balls, pebbles, or ceramic hard balls, for example.

In the case of demolishing an object to be demolished, or concrete 2 for example, using said demolishing apparatus using discharge impulse 1, an installation hole 3 is formed in a to-be-demolished portion of said concrete 2, then the container 4, which has the metal wire 6 inserted thereinto, the demolishing material 7 and the granular material 8 filled therein, and a cover element 10 affixed to an opening at the upper end thereof, is inserted into the installation hole 3. Next, the electrical energy supplying device is connected through the electrical wiring 9.

Then a discharge switch installed on the discharge circuit is turned on and electrical energy (discharge energy) is supplied to the metal wire 6 for a short time. Whereupon the metal wire 6 suddenly melts and vaporizes. Following this, the demolishing material 7 also vaporizes and transmits the volume expansion force of the metal wire 6 to the concrete 2, such that the volume expansion force, in combination with the vaporization and expansion force of the demolishing material 7, forms a demolishing force and demolishes the concrete 2.

Since the granular material 8, such as metal balls, is mixed in the demolishing material 7, the granular material 8 also flies apart into the surroundings with extremely strong force caused by the volume expansion force of the metal wire 6, whereby the concrete 2 is demolished reliably.

In this way, since a lot of granular material 8 is mixed in the demolishing material 7, the volume expansion force of the metal wire 6 can be efficiently transmitted to the surroundings.

Figure 2:
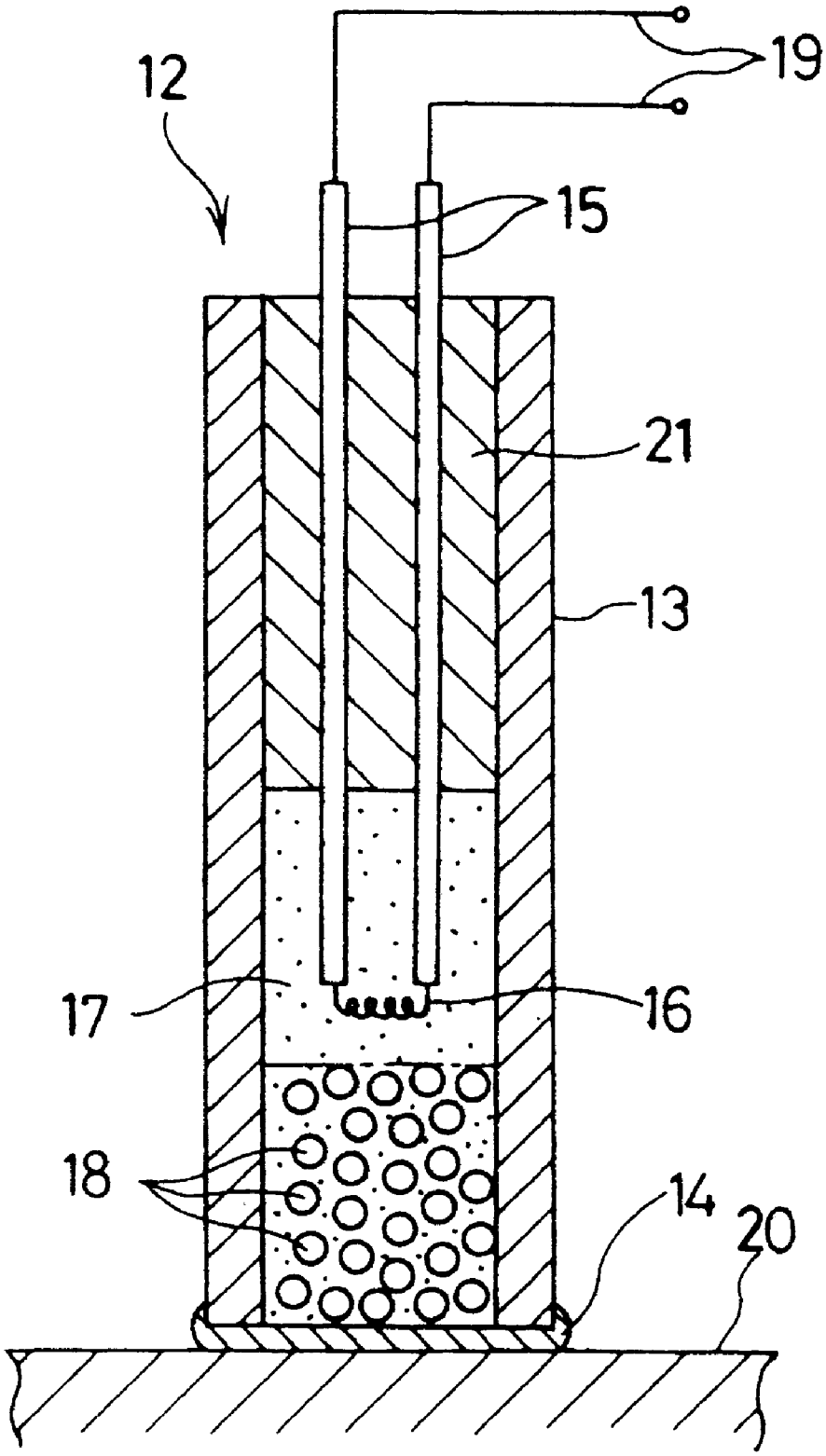
FIG. 2 is a cross section showing the installed state of a demolishing apparatus using discharge impulse in an object to be demolished according to the second embodiment of the present invention.

Next, the second embodiment for implementing the present invention is explained on the basis of FIG. 2. The demolishing apparatus using discharge impulse 12 in this second embodiment comprises: a cylindrical container 13 having an opening at both upper and lower ends; a stopper element 14 affixed to the opening at the lower end of the cylindrical container 13; a pair of electrodes 15 inserted in the cylindrical container 13; a metal wire (an example as a melting and vaporizing material, such as copper, iron or aluminum) 16 connecting the end portions of the electrodes 15; a demolishing material 17 and a granular material 18 for filling the cylindrical container 13; and an electrical energy supplying device (not depicted) to supply high voltage electrical energy for a short time to the base portions of the pair of electrodes 15 through electrical wiring 19.

The electrical energy supplying device comprises: a charger, such as a capacitor, which accumulates high voltage electrical energy; a charging circuit to charge this capacitor; and a discharge circuit to supply the electrical energy charged in the capacitor to the pair of electrodes 15 so as to effect discharge.

Also, the cylindrical container 13 is formed of a hard material such as metal, and the stopper element 14 is formed of a soft material such as thin resin film (wrapping film) used for storing food, vinyl, paper, rubber, thin metal plate or the like. In other words, the stopper element 14 is provided simply to prevent the granular material 18 filled in the cylindrical container 13 from escaping to the outside, and can easily be broken when the volume of the metal wire 16 expands. If the demolishing material 17 is in the solid form such as a gel, the stopper element 14 need not be installed.

Further, like in the first embodiment, a solid or semisolid material, for example, is used as the demolishing material 17. To be more specific, it is mortar, mud, silicone, or gel. And, metal balls, pebbles, or ceramic balls, for example, are used as the granular material 18.

In order to demolish an object to be demolished, for example concrete 20, by using the foregoing demolishing apparatus using discharge impulse 12, a cylindrical container 13 which has a stopper element 14 attached to the opening at the lower end thereof, a metal wire 16 placed therein, a demolishing material 17 and a granular material 18 both filled therein, and a cover element 21 affixed to the opening at the upper end thereof, is placed on a to-be-demolished portion of the concrete 20. Then, an electrical energy supplying device is connected through electrical wiring 19.

Then the discharge switch installed on the discharge circuit is turned on and electrical energy (discharge energy) is supplied to the metal wire 16 in a short time. Whereupon the metal wire 16 suddenly melts and vaporizes. Following this, the demolishing material 17 also vaporizes and transmits the volume expansion force of the metal wire 16 to the concrete 20, said volume expansion force combining with the vaporization and expansion force of the demolishing material 17 to form a demolishing force, thereby demolishing the concrete 20.

Since the granular material 8, such as metal balls, is mixed in the demolishing material 7, the granular material 8 also flies apart into the surroundings with extremely strong force due to the volume expansion force of the metal wire 6, whereby the concrete 2 is demolished reliably.

Also the granular material 18 mixed in the cylindrical container 13 is filled to a height of half that of the demolishing material 17, for example. Because the granular material 18 is positioned on the side toward the opening in the lower end in the cylindrical container 13, the portion above the granular material 18 functions as a pressure producing portion with only the metal wire 16 placed in the demolishing material 17.

Consequently, during the melting and vaporization of the metal wire 16, the granular material 18, positioned on the side toward the opening in the lower end in the container 13, breaks through the stopper element 14 from the cylindrical container 13 like a shotgun shell and is discharged all at once toward the concrete 20, whereby the demolishing force is concentrated by the granular material 18 and the concrete 20 is demolished reliably.

Figure 3:
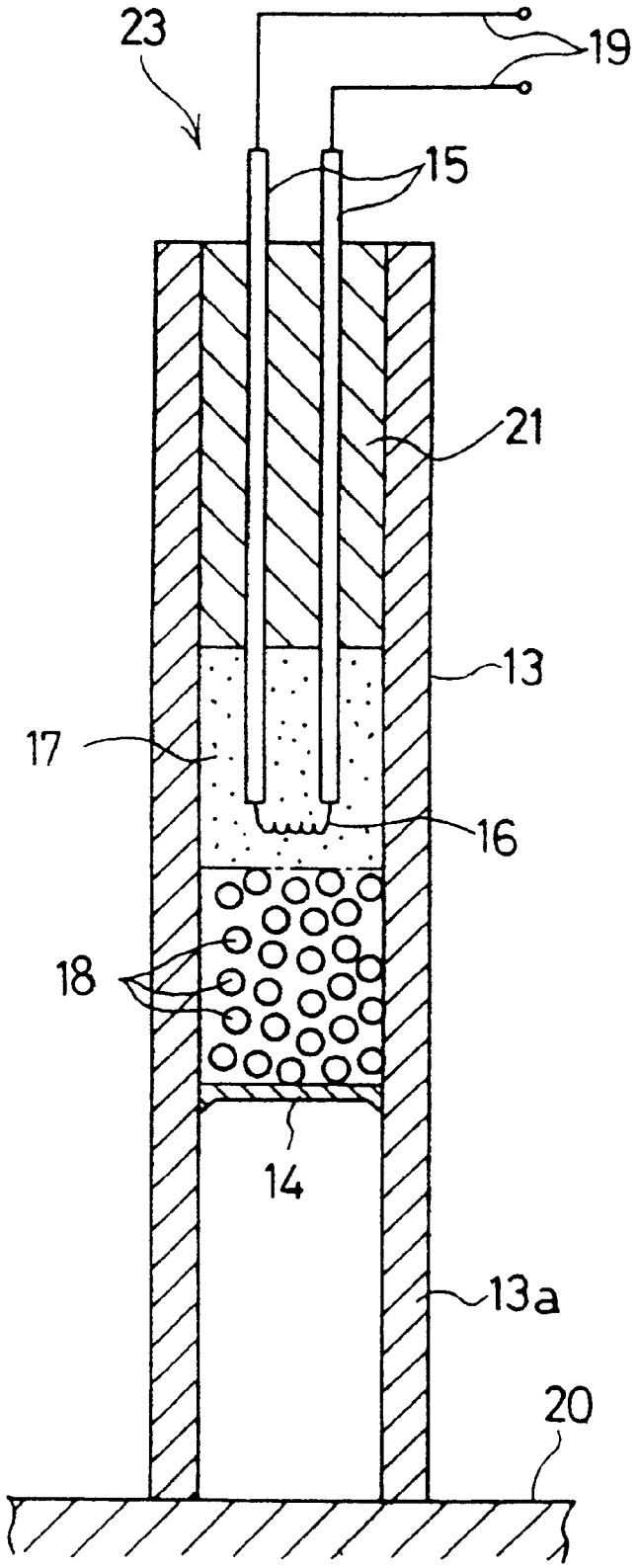
FIG. 3 is a cross section showing the installed state of a demolishing apparatus using discharge impulse in an object to be demolished according to the third embodiment of the present invention.

Next, the third embodiment for implementing the present invention is explained on the basis of FIG. 3. This demolishing apparatus using discharge impulse 23 in this third embodiment has about the same constitution as the above mentioned second embodiment. The same symbols are applied to the same elements and a detailed explanation thereof is omitted.

In other words, as shown in FIG. 3, an extension portion 13*a* is formed which extends straight just from the cylindrical container 13 below a stopper element 14 provided at the lower end of the cylindrical container 13 in the second embodiment.

With this constitution, when an object to be demolished, such as concrete 20, is about to be demolished, the opening on the lower end of the extension portion 13*a* of the cylindrical container 13 having the metal wire 16, demolishing material 17, and granular material 18 placed therein, is held in the state of being pressed against a to-be-demolished portion of the concrete 20, and electrical energy is supplied to the metal wire 16, whereby the demolishing material 17 and granular material 18 together are ejected toward the concrete 20, with the volume expansion force of the metal wire 16, thereby demolishing the concrete 2. At this time, the straight extension portion 13*a* of the cylindrical container 13 plays the role of a barrel and guides a large number of granules of the granular material 18 in the same direction, thereby increasing the demolishing force to be even stronger.

Figure 4:
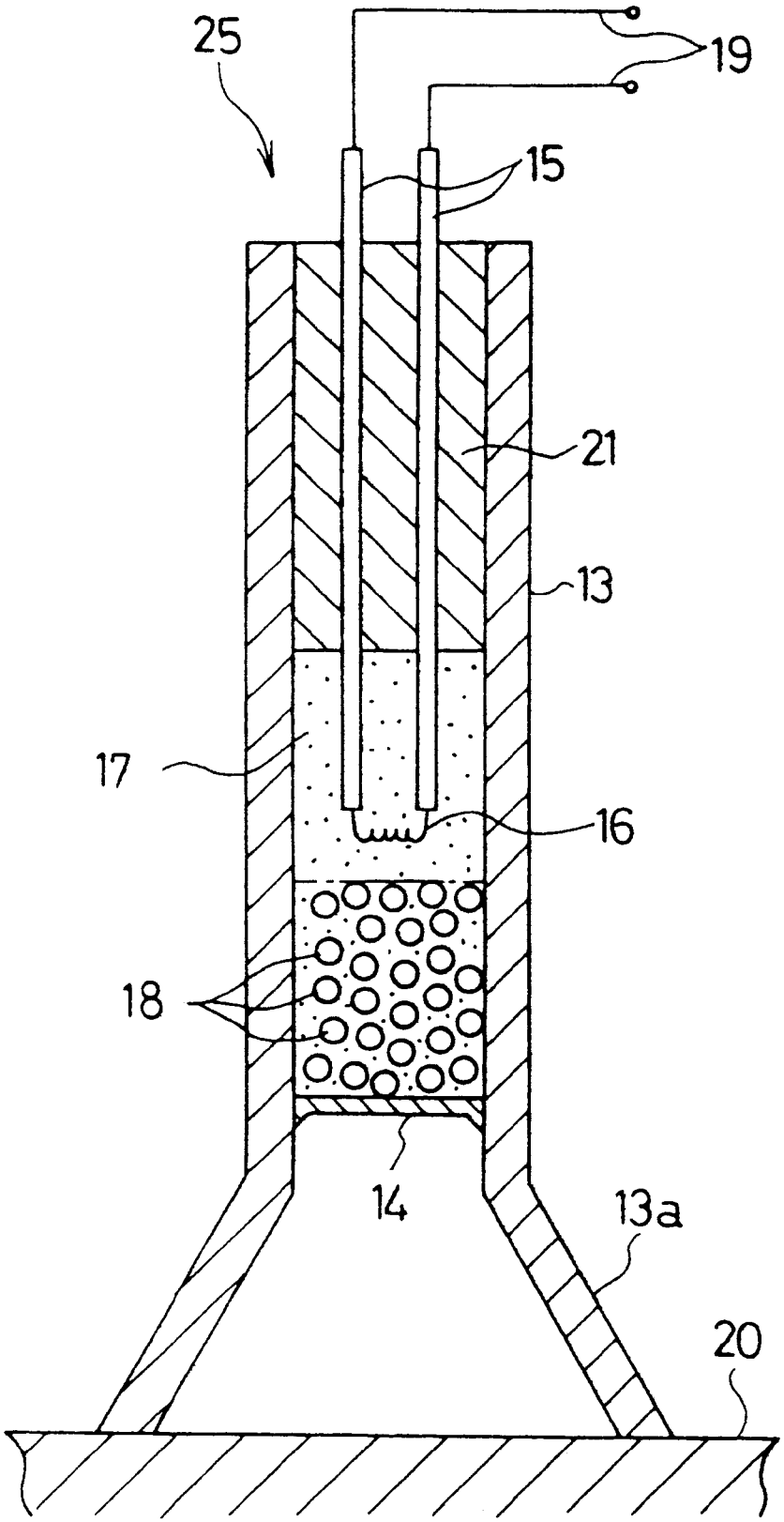
FIG. 4 is a cross section showing the installed state of a demolishing apparatus using discharge impulse in an object to be demolished according to the fourth embodiment of the present invention.

Next, the fourth embodiment for implementing the present invention is explained on the basis of FIG. 4. In the demolishing apparatus using discharge impulse 23 in the above mentioned third embodiment, the downward extension portion 13a of the cylindrical container 13 was straight in form. However, in the demolishing apparatus using discharge impulse 25 according the fourth embodiment, the extension portion is formed in a conical shape such that the inner diameter of the opening on the lower end of the cylindrical container 13 is greater than the inner diameter of the portion where the stopper element 14 is provided.

In addition to the effects obtained from the demolishing apparatus using discharge impulse 23 according to the third embodiment, this constitution allows it to control the volume expansion force of the metal wire 16 and the range of ejection of the granular material 18, which become the demolishing force during the melting and vaporization of the metal wire 16.

Figure 5:
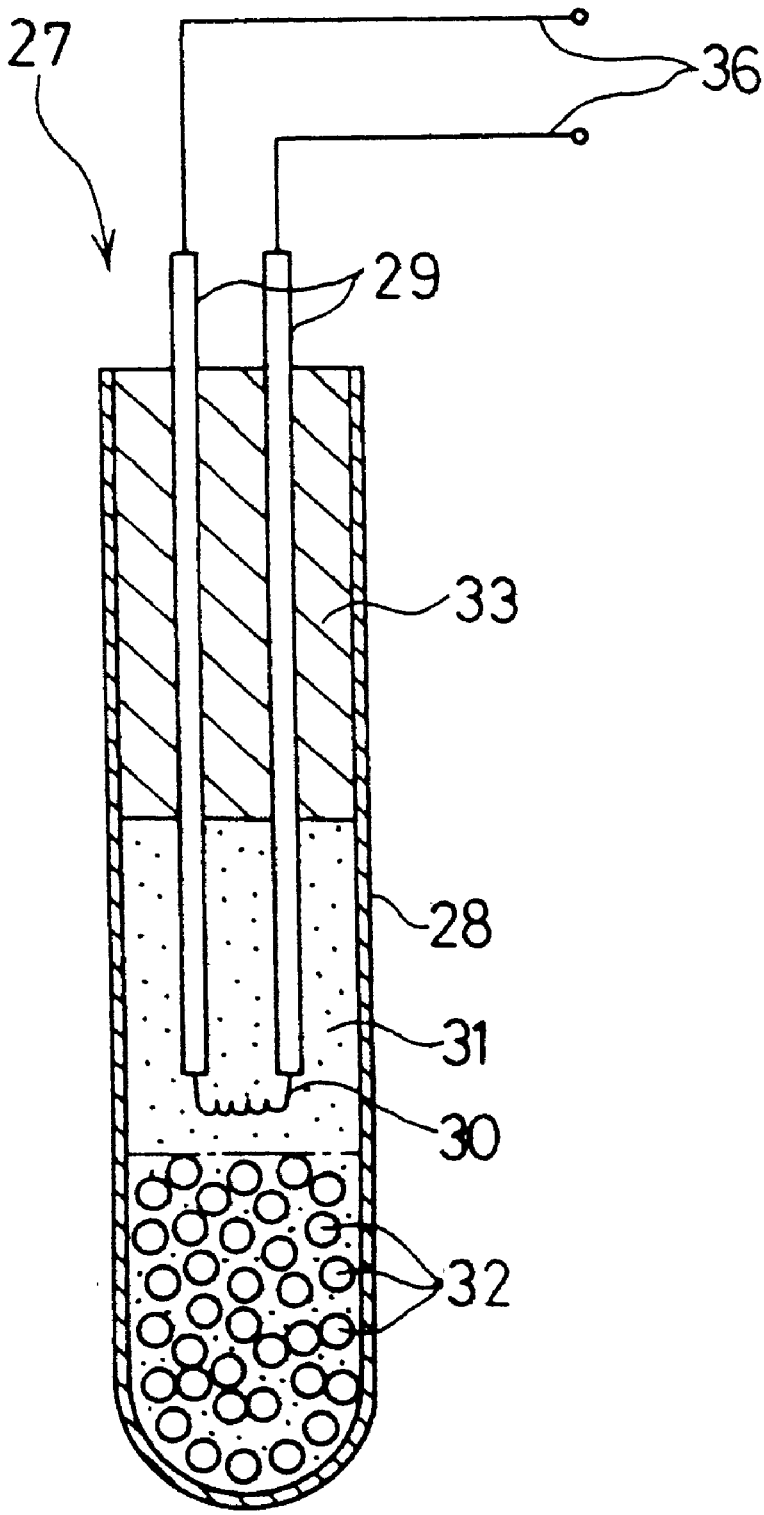
FIG. 5 is a cross section showing the constitution of a demolishing apparatus using discharge impulse according to the fifth embodiment of the present invention.
Figure 6:
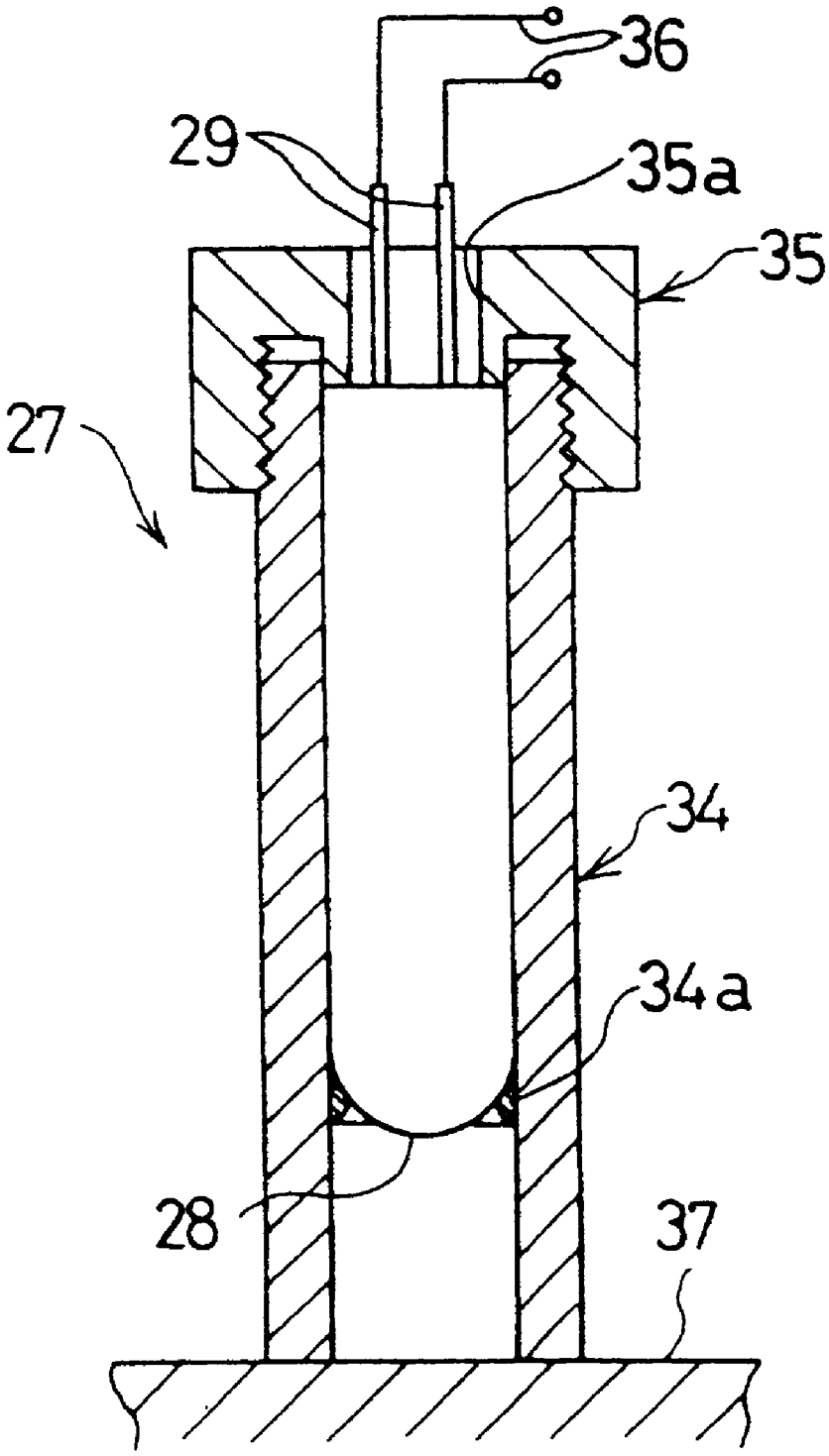
FIG. 6 is a cross section showing the installed state of the demolishing apparatus using discharge impulse in an object to be demolished according to the fifth embodiment of the present invention.
Figure 7:
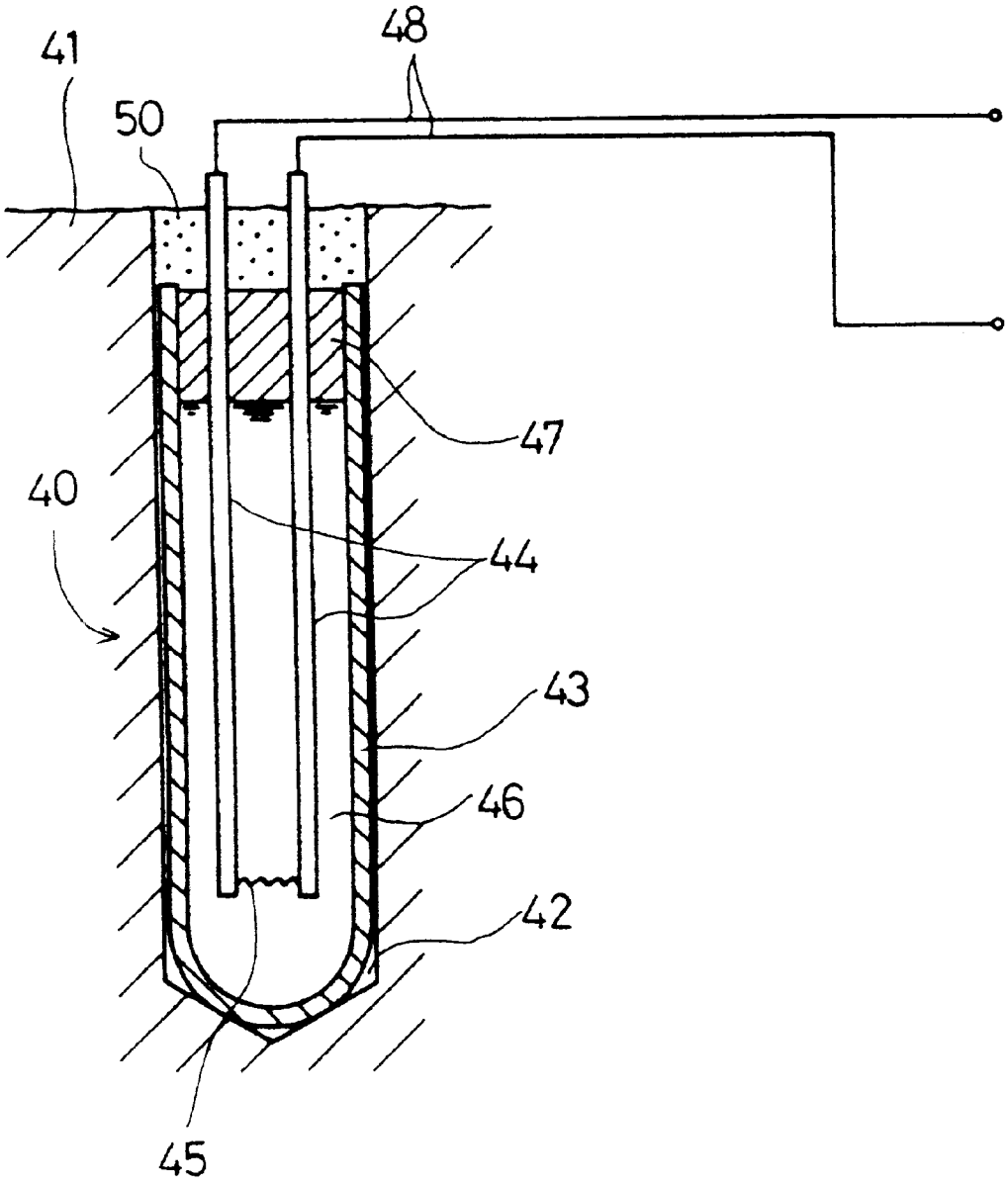
FIG. 7 is a cross section showing the installed state of a demolishing apparatus using discharge impulse in an object to be demolished according to the sixth embodiment of the present invention.
Figure 8:
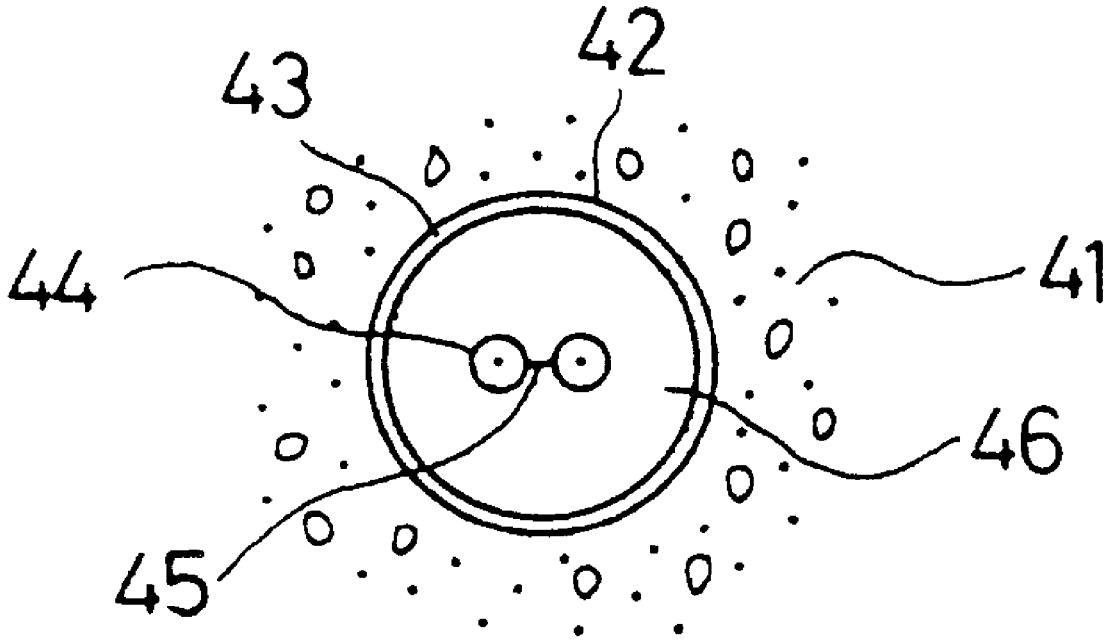
FIG. 8 is a plan view showing the installed state before demolition of the demolishing apparatus using discharge impulse in an object to be demolished according to the sixth embodiment of the present invention.

Next, the fifth embodiment for implementing the present invention is explained on the basis of FIGS. 5 and 6. The demolishing apparatus using discharge impulse 27 according to the fifth embodiment comprises: a cylindrical or pouch-shaped demolishing container (hereinafter referred to simply as "container") 28 having a bottom; a pair of electrodes (or conductive wires) 29 inserted in the container 28; a metal wire (an example as a melting and vaporizing material, such as copper, iron or aluminum) 30 connecting the end portions of the electrodes 29; a demolishing material 31 and granular material 32 filling the container 28; a cylindrical holding body 34 which holds the container 28 being filled with the electrodes 29, demolishing material 31 and granular material 32 and having a cover element 33 fixed in the opening at the upper end thereof, and which has an opening at both upper and lower ends thereof; a cover body 35 screwed onto the opening at the upper end of the cylindrical holding body 34; and an electrical energy supplying device (not depicted) to supply high voltage electrical energy in a short time to the base portions of the pair of electrodes 29 through electrical wiring 36. Moreover, a hole portion 35*a* is formed in the cover body 35 so as to allow passage of the electrodes 29.

The electrical energy supplying device comprises: a charger, such as a capacitor, to accumulate high voltage electrical energy; a charging circuit to charge this capacitor; and a discharge circuit to supply electrical energy charged in the capacitor to the pair of electrodes 29 so as to effect discharge.

The container 28 is formed of an elastic material such as rubber or a soft material such as synthetic resin. Further, a solid or semisolid material, for example, is used as the demolishing material 31, more specifically, it is mortar, mud, silicone or gel, and metal balls, pebbles or ceramic balls, for example, are used as the granular material 32.

When an object to be demolished, such as concrete 37, is demolished using the foregoing demolishing apparatus using discharge impulse 27, the cover element 33 is fixed in the opening portion at the upper end of the container 28 filled with the metal wire 30, demolishing material 31 and granular material 32, as shown in FIG. 5, and subsequently, as shown in FIG. 6, the container 28 is inserted in the cylindrical holding body 34 in such a manner as to face the concrete 37 by being held by a ring-shaped protruding portion (the protruding portion may simply consists of a plurality of protrusions provided at a plurality of locations) 34*a* protruding at a prescribed location inside the cylindrical holding body 34. Thereafter the cover body 35 is screwed onto the opening at the upper end to hold the entire container 28.

The cylindrical holding body 34 holding the container 28 is placed to be pressed against a to-be-demolished portion of the concrete 37. As electrical energy is supplied to the metal wire 30 in this state, powerful demolition can be effected in the same way as in the third embodiment.

Next, the sixth embodiment for implementing the present invention is explained on the basis of FIGS. 7 through 11. The demolishing apparatus using discharge impulse 40 in this sixth embodiment comprises: a cylindrical or pouch-shaped container 43 having a bottom and being inserted in an installation hole 42 formed in an object to be demolished 41; a pair of electrical wires (electrodes) 44 inserted in this container 43; a metal wire (an example as a melting and vaporizing material, such as copper, iron or aluminum) 45 connecting the end portions of the electrical wires 44; a demolishing material 46 filling the container 43; a cover element 47 to seal this demolishing material 46; and an electrical energy supplying device (not depicted) to supply high voltage electrical energy for a short time to the base portions of the pair of electrical wires 44 through electrical wiring 48.

The foregoing metal wire 45 is immersed in the demolishing material 46, said demolishing material 46 being composed of an inflammable material such as thinner or kerosene, or an explosive material.

The foregoing electrical energy supplying device comprises: a charger, such as a capacitor, to accumulate high voltage electrical energy; a charging circuit to charge this capacitor; and a discharge circuit to supply the electrical energy charged in the capacitor to the pair of electrical wires 44 so as to effect discharge.

When an object to be demolished, such as a concrete 41, is demolished using the foregoing demolishing apparatus using discharge impulse 40, the container 43 is filled with the demolishing material 46, the demolishing material 46 is sealed with the cover element 47 which the electrical wires 44 pass through, the container 43 is inserted in the installation hole 42 formed in the concrete, the installation hole 42 is filled with tamping material 50 such as sand, and the electrical energy supplying device is connected to the metal wire 45 through the electrical wiring 48.

Then the discharge switch installed on the discharge circuit is turned on and electrical energy (discharge energy) is supplied to the metal wire 45 for a short time. Whereupon the metal wire 45 suddenly melts and vaporizes. Following this, the demolishing material 46 also burns and vaporizes (explodes) together and transmits the volume expansion force of the metal wire 45 to the concrete 41, said volume expansion force combining with the vaporization and expansion force of the demolishing material 47 to form a demolishing force, thereby demolishing the concrete 20.

Figure 9:
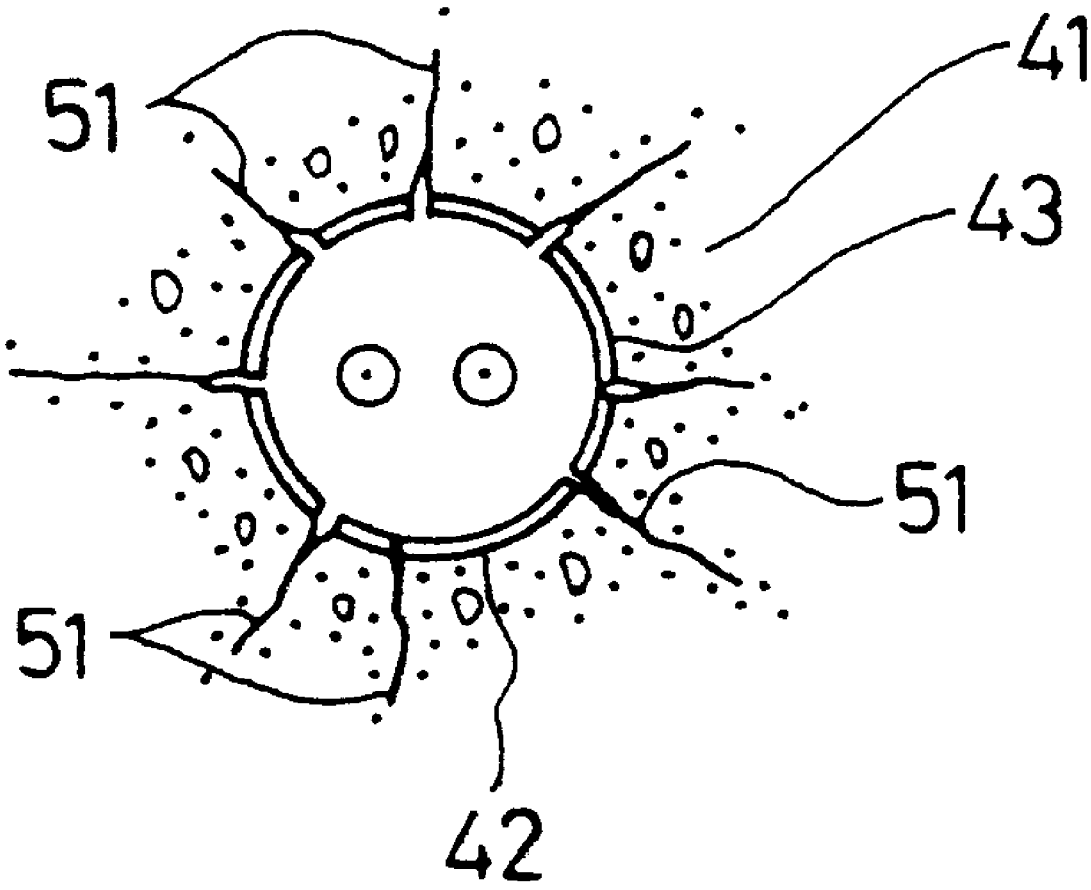
FIG. 9 is a plan view showing the state during demolition of the demolishing apparatus using discharge impulse in an object to be demolished according to the sixth embodiment of the present invention.
Figure 10:
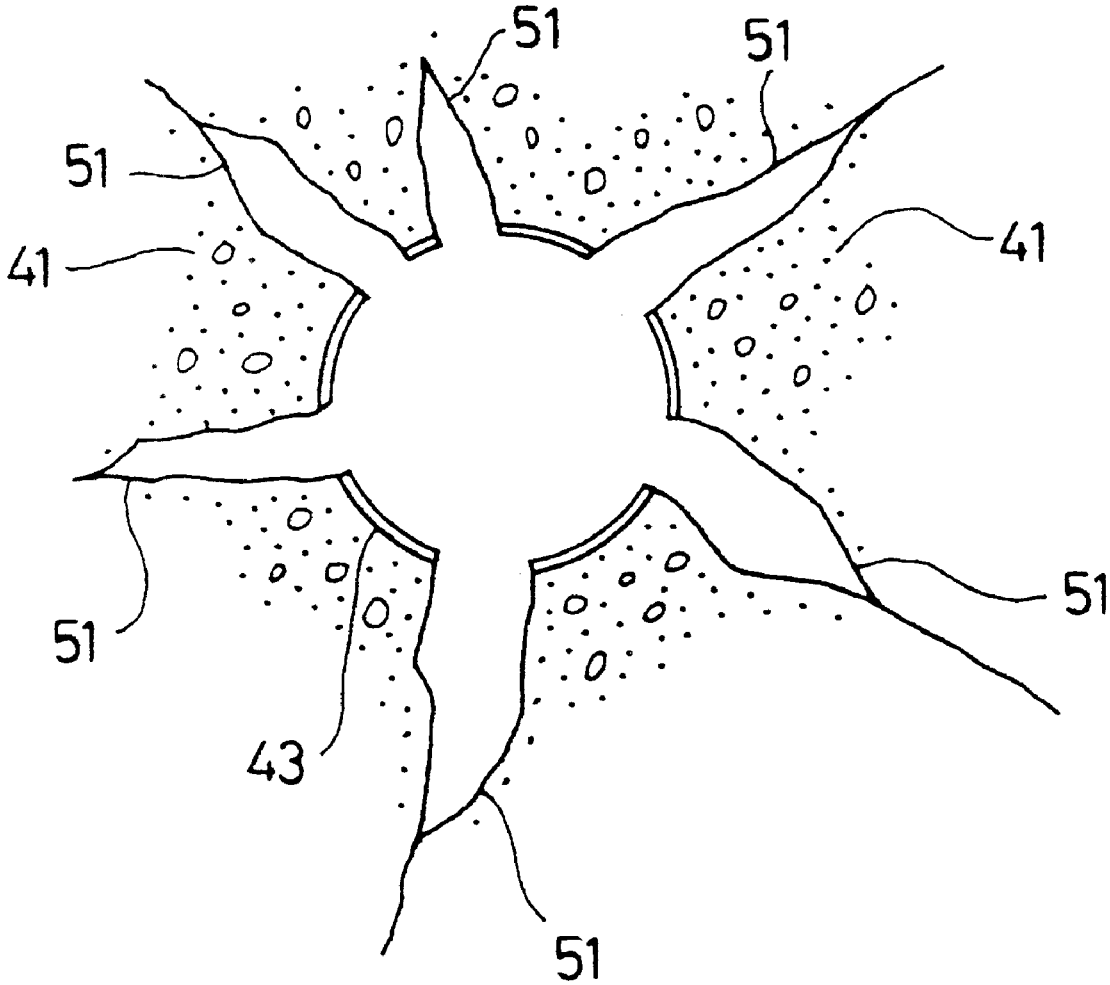
FIG. 10 is a plan view showing the completed state of demolition of the object to be demolished for the demolishing apparatus using discharge impulse showing the sixth embodiment of the present invention.

Here is an explanation of the sequence in which the concrete 41 is demolished. With the volume expansion force generated during the melting and vaporization of the metal wire 45, a plurality of cracks 51 occur around the installation hole 42 as shown in FIG. 9. Subsequently, after a passage of a small period of time t, the demolishing material 46 burns and vaporizes, and the force of vaporization and expansion thereof acts on the cracks 51 and expands these cracks 51 outward, as shown in FIG. 10, thereby destroying the concrete 41.

Figure 11:
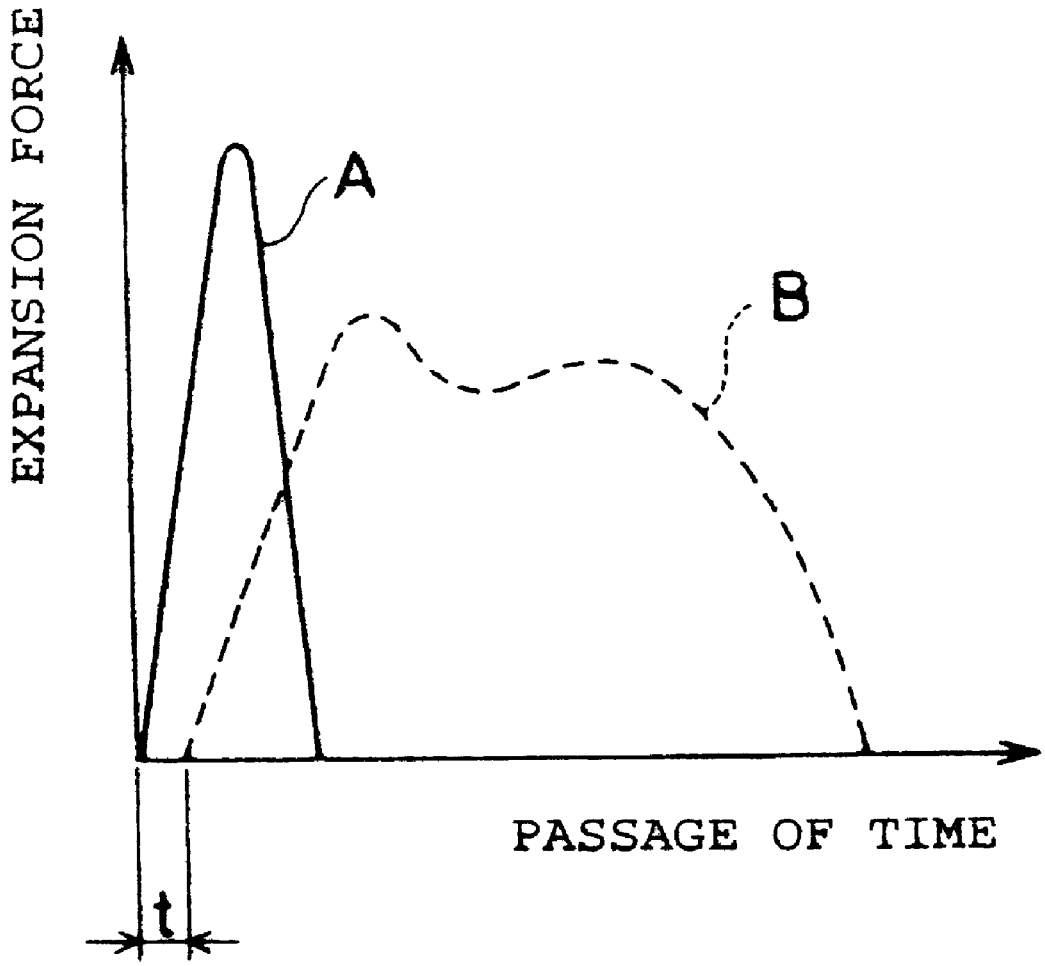
FIG. 11 is a graph showing the relationship between the passage of time and expansion force in the demolishing apparatus using discharge impulse according to the sixth embodiment of the present invention.

FIG. 11 is a graph in which the horizontal axis represents the passage of time since the supply of electrical energy and the vertical axis the vaporization and expansion force of the metal wire at the time of volume expansion thereof. The solid line A shows the case where the metal wire 45 suddenly melts and vaporizes, and the broken line B shows how the vaporization and expansion force produced when the demolishing material 46 burns and vaporizes acts on each crack 51. It is known from this graph that the vaporization and expansion force of the demolishing material 46 acts gradually on each crack 51 in the object to be demolished 41.

In the above mentioned sixth embodiment, an inflammable material or explosive material is used as the demolishing material 46 to be filled in the container 43. As a result, the vaporization and expansion force of the demolishing material 46 acts gradually on the plurality of cracks 51 caused to occur by the volume expansion force of the metal wire 45, and the cracks 51 are expanded outward, whereby the concrete 41 is demolished reliably.

Figure 12:
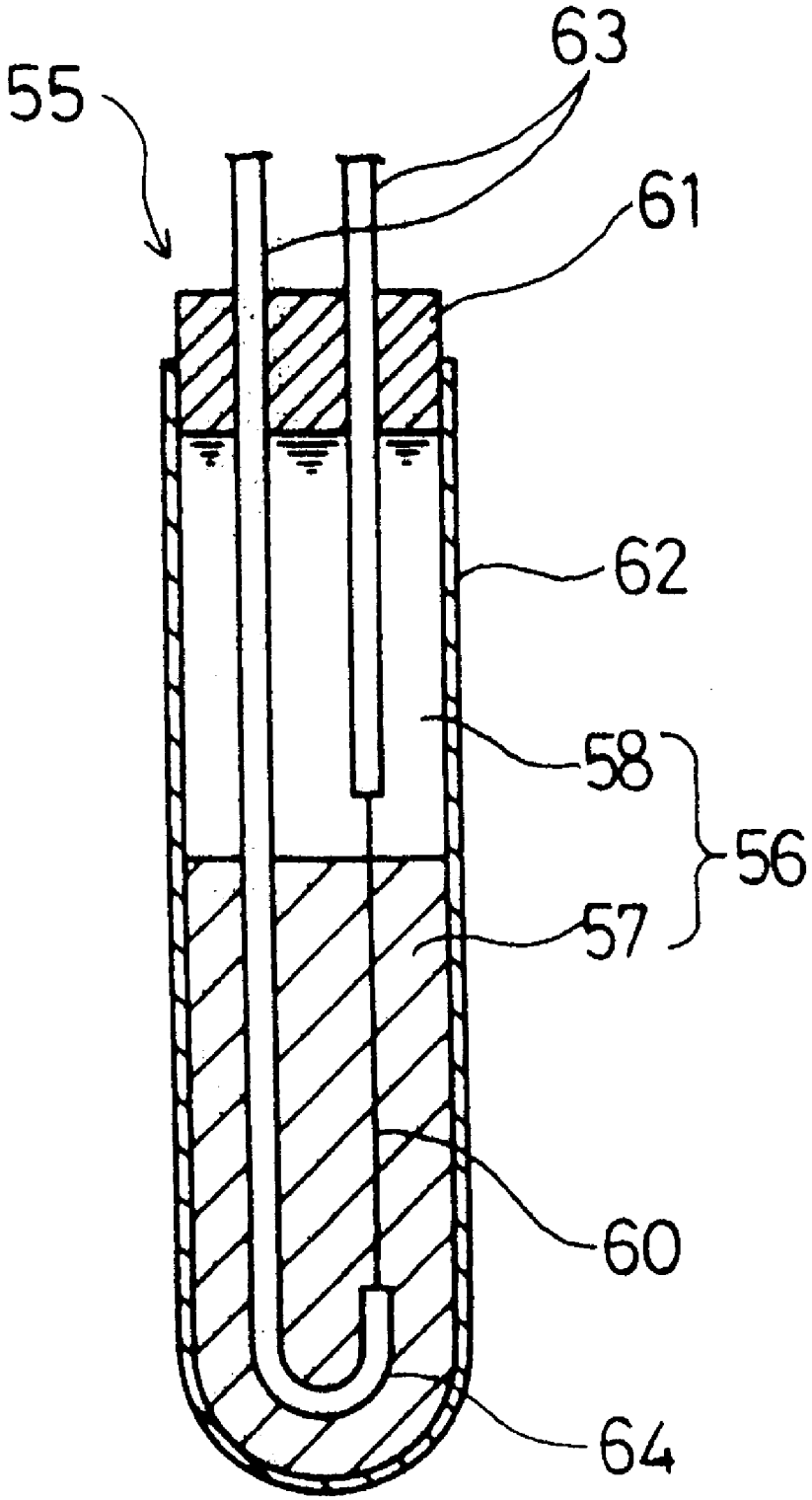
FIG. 12 is a cross section showing the constitution of a demolishing apparatus using discharge impulse according to the seventh embodiment of the present invention.

Next, the seventh embodiment for implementing the present invention is explained on the basis of FIG. 12. In the demolishing apparatus using discharge impulse 55 according to the seventh embodiment, the demolishing material 56 comprises a stable material 57 in the form of a gel and an inflammable material 58 in the form Qf a liquid, said stable material 57 and inflammable material 58 being separated in the container 50, and a metal wire 60 is immersed in both of the stable material 57 and the inflammable material 58.

A cover element 61 to seal the demolishing material 56 is installed on the container 62, and an electrical energy supplying device (not depicted) for supplying high voltage electrical energy for a short time to the metal wire 60 is connected to the base portions of a pair of electrical wires (electrodes) 63. Also, the metal wire 60 is made to expose itself by removing part of a covering element 64 of the electrical wires 63 partway.

The foregoing electrical energy supplying device comprises: a charger, such as a capacitor, to accumulate high voltage electrical energy; a charging circuit to charge this capacitor; and a discharge circuit to supply the electrical energy charged in the capacitor to the pair of electrical wires 63 so as to effect discharge.

When an object to be demolished is demolished using the foregoing demolishing apparatus using discharge impulse 40, the container 62 is filled with the demolishing material 56, the demolishing material 56 is sealed with the cover element 61 which the electrical wires 63 pass through, the container 62 is inserted in the installation hole formed in the object to be demolished, the installation hole is filled with a tamping material such as sand, and the electrical energy supplying device is connected to the metal wire 60 through the electrical wiring 63.

Then the discharge switch installed on the discharge circuit is turned on and electrical energy (discharge energy) is supplied to the metal wire 60 for a short time. Whereupon the metal wire 60 suddenly melts and vaporizes. Following this, the stable material 57 vaporizes and the inflammable material 58 also burns and vaporizes, thereby transmitting the volume expansion force of the metal wire 60 to the object to be demolished, and the volume expansion force of the metal wire 60 combines with the vaporization and expansion force of the demolishing material 56 so as to form a demolishing force to the effect of demolishing the object to be demolished.

Here is an explanation of the sequence in which the object to be demolished is demolished. With the volume expansion force generated during the melting and vaporization of the metal wire 60, the stable material 57 vaporizes and the volume expansion force of the metal wire 60 is transmitted, and a plurality of cracks occur around the installation hole. Subsequently, after a passage of a small period of time t, the inflammable material 58 also burns and vaporizes, and the vaporization and expansion force thereof acts on the cracks to expand these cracks outward, thereby demolishing the object to be demolished reliably.

INDUSTRIAL APPLICABILITY

As discussed above, the demolishing apparatus using discharge impulse relating to the present invention can be advantageously used in the case of demolishing an object to be demolished that requires a great demolishing force.

What is claimed is:

1. A demolishing apparatus using discharge impulse to suddenly melt and vaporize a melting and vaporizing material, said apparatus comprising:

a container with an open end;

a first electrode or conductive wire with insulating covering with an upper and a lower end portion;

a second electrode or conductive wire with insulating covering with an upper and a lower end portion;

a cover element containing two openings for receiving said first electrode and said second electrode for attachment to the open end of the container;

electrical wiring connected to the upper end portions of said first and second electrodes;

a solid and/or semi-solid demolishing material;

a granular material selected from the group consisting of metal balls, ceramic balls and pebbles, said granular material being dispersed in said demolishing material; and a melting and vaporizing material connected to the lower end portion of said first electrode and to the lower end portion of said second electrode, said material generating said discharge impulse to supply electrical energy for a short period of time;

wherein said container contains the lower end portion of said first and said second electrodes, said melting and vaporizing material, and said granular material dispersed in said demolishing material; and wherein said melting and vaporizing material melts and vaporizes in response to the generation of the discharge impulse;

said demolishing material vaporizing and expanding, in response to the melting and vaporizing of said melting and vaporizing material; and, in combination with said discharge impulse of said melting and vaporizing material and the vaporizing and expanding of said demolishing material, said granular material accelerating in response to the discharge impulse and the vaporizing and expanding, said granular material transmitting forces to the surroundings to demolish an object.

2. A demolishing apparatus according to claim 1, wherein said melting and vaporizing material is metal wire.

3. A demolishing apparatus using discharge impulse to suddenly melt and vaporize a melting and vaporizing material, said apparatus comprising:

a container with an open end, said container made of an elastic material;

a first electrode or conductive wire with insulating covering with an upper and a lower end portion;

a second electrode or conductive wire with insulating covering with an upper and a lower end portion;

a cover element containing two openings for receiving said first electrode and said second electrode for attachment to the open end of the container;

electrical wiring connected to the upper end portions of said first and second electrodes;

a solid and/or semi-solid demolishing material;

a granular material selected from the group consisting of metal balls, ceramic balls and pebbles, said granular material being dispersed in said demolishing material; and a melting and vaporizing material connected to the lower end portion of said first electrode and to the lower end portion of said second electrode, said material generating said discharge impulse to supply electrical energy for a short period of time;

a cylindrical holding body having an open upper end and an open lower end with a ring-shaped protruding portion at said lower end, said ring-shaped protruding portion receiving and holding said container; and a cover body having an opening through which said first electrode and said second electrode can pass and being detachably connected to the upper end of the cylindrical holding body;

wherein said container contains the lower end portion of said first and said second electrodes, said melting and vaporizing material, and said granular material dispersed in said demolishing material; and wherein said lower end of said cylindrical holding body is installable to face an object;

said melting and vaporizing material melts and vaporizes in response to the generation of the discharge impulse;

said demolishing material vaporizing and expanding, in response to the melting and vaporizing of said melting and vaporizing material; and, in combination with said discharge impulse of said melting and vaporizing material and the vaporizing and expanding of said demolishing material, said granular material accelerating in response to the discharge impulse and the vaporizing and expanding, said granular material transmitting forces to the surroundings to demolish an object.

4. A demolishing apparatus according to claim 3, wherein said melting and vaporizing material is metal wire.

5. A demolishing apparatus using discharge impulse to suddenly melt and vaporize a melting and vaporizing material, said apparatus comprising:

a cylindrical container made of hard material and having an upper open end and a lower open end;

a first electrode or conductive wire with insulating covering with an upper and a lower end portion;

a second electrode or conductive wire with insulating covering with an upper and a lower end portion;

a cover element containing two openings for receiving said first electrode and said second electrode for attachment to the upper open end of the container;

electrical wiring connected to the upper end portions of said first and second electrodes;

a solid and/or semi-solid demolishing material;

a granular material selected from the group consisting of metal balls, ceramic balls and pebbles, said granular material being dispersed in said demolishing material; and a melting and vaporizing material connected to the lower end portion of said first electrode and to the lower end portion of said second electrode, said material generating said discharge impulse to supply electrical energy for a short period of time;

said container contains the lower end portion of said first and said second electrodes, said melting and vaporizing material, and said granular material dispersed in said demolishing material; and said melting and vaporizing material melts and vaporizes in response to the generation of the discharge impulse;

said demolishing material vaporizing and expanding, in response to the melting and vaporizing of said melting and vaporizing material; and, in combination with said discharge impulse of said melting and vaporizing material and the vaporizing and expanding of said demolishing material, said granular material accelerating in response to the discharge impulse and the vaporizing and expanding, said granular material transmitting forces to the surroundings to demolish an object.

6. A demolishing apparatus according to claim 5, further comprising:

a stopper element made of a soft material to cover the lower open end of the container.

7. A demolishing apparatus according to claim 5, further comprising:

a stopper element made of a soft material for completely covering the inside diameter of the lower open end of the container resulting in space between the stopper element and the lower open end of the container, said space functioning as a barrel and guiding the granular material in the same direction, to increase the demolishing force.

8. A demolishing apparatus according to claim 5, further comprising:

a funnel-shaped container having a narrow end and a wide end, said narrow end attached to the lower open end of the cylindrical container; and a stopper element made of a soft material for completely covering the inside diameter of the lower open end of the cylindrical container resulting in space between the stopper element and the lower open end of the cylindrical container, said space controlling the range of ejection of the granular material, to increase the demolishing force.

9. A demolishing apparatus according to claim 5, wherein said melting and vaporizing material is metal wire.

10. A demolishing apparatus using discharge impulse to suddenly melt and vaporize a melting and vaporizing material, said apparatus comprising:

a container with an open end, said container made of an elastic material;

a first electrode or conductive wire with insulating covering with an upper and a lower end portion; a second electrode or conductive wire with insulating covering with an upper and a lower end portion;

a cover element containing two openings for receiving said first electrode and said second electrode for sealing the open end of the container;

electrical wiring connected to the upper end portions of said first and second electrodes;

a demolishing material, composed of at least one of an inflammable material and an explosive material; and a melting and vaporizing material connected to the lower end portion of said first electrode and to the lower end portion of said second electrode, said material generating said discharge impulse to supply electrical energy for a short period of time;

wherein said container contains the lower end portion of said first and said second electrodes, said melting and vaporizing material, and said demolishing material; and said melting and vaporizing material melts and vaporizes in response to the generation of the discharge impulse;

said demolishing material vaporizing and expanding, in response to the melting and vaporizing of said melting and vaporizing material; and, in combination with said discharge impulse of said melting and vaporizing material and the vaporizing and expanding of said demolishing material, said granular material accelerating in response to the discharge impulse and the vaporizing and expanding, said granular material transmitting forces to the surroundings to demolish an object.

11. A demolishing apparatus according to claim 10, further comprising:

a stable material in the form of a gel separated from said demolishing material in said container; and wherein the lower end portion of said first and said second electrodes lacks insulated cover and is exposed to surrounding material residing in both said demolishing material and said stable material.

12. A demolishing apparatus according to claim 10, wherein said melting and vaporizing material is a metal wire.

* * * * *